United States Patent [19]

Hadeishi

[11] 4,263,533

[45] Apr. 21, 1981

[54] MAGNETICALLY CONTAINED ARC DISCHARGE LAMP WITH CROSSED ELECTRIC AND MAGNETIC FIELDS

[76] Inventor: Tetsuo Hadeishi, 22 Camelot Ct., Berkeley, Calif. 94707

[21] Appl. No.: 920,673

[22] Filed: Jun. 30, 1978

[51] Int. Cl.[2] ..... H01J 1/50; H05B 31/28

[52] U.S. Cl. ..... 315/111.9; 313/156; 313/161; 315/176

[58] Field of Search ..... 356/313, 314, 316; 313/156–161, 231.4–231.6, 231.7; 315/111.4, 111.9, 176

[56] References Cited

PUBLICATIONS

Vukanovic et al., *Spectrochimica Acta*, vol. 29B, No. 2, pp. 33–36, 1979.

Pasternak et al., Journal of Applied Physics, vol. 46, No. 3, pp. 1135–1140, Mar. 1975.

*Primary Examiner*—F. L. Evans

*Attorney, Agent, or Firm*—Yoshio Katayama

[57] ABSTRACT

A light source for Zeeman spectroscopy wherein an anode in an ionizable gas is used for ion bombardment of a cathode having materials therein whose spectra is to be observed. The anode and cathode are mounted in a magnetically permeable housing which fits snugly between pole pieces of a magnet such that the magnetic field between pole pieces is perpendicular to the electric field between the anode and cathode so that the arc discharge therebetween is spacially limited to a narrow dimension, i.e., a line, for improved Zeeman atomic absorption spectroscopy.

12 Claims, 7 Drawing Figures

MAGNETICALLY CONTAINED ARC DISCHARGE LAMP WITH CROSSED ELECTRIC AND MAGNETIC FIELDS

BACKGROUND OF THE INVENTION

This invention was made in the course of, or under, a contract with the United States Department of Energy with support by the RANN Division of the National Science Foundation.

a. Field of the Invention

The invention relates to a light source for Zeeman atomic absorption spectroscopy.

b. Prior Art

One of the most difficult problems associated with Zeeman atomic absorption spectrophotometer is finding a light source which operates in a strong magnetic field for refractory and volatile elements. In spite of the powerful features of the Zeeman atomic absorption spectrophotometer, rapid acceptance has been delayed because of the light source problem.

Prior Zeeman atomic absorption spectrophotometers are described in U.S. Pat. Nos. 3,811,788; 3,914,054 and 3,957,375.

Originally, specially designed electrodeless discharge lamps (EDL) were used for Zeeman atomic absorption spectrophotometer for elements such as Hg, Cd, As, Se, Zn and Pb in a strong magnetic field. However, in spite of a development effort, the electrodeless discharge lamp failed to operate reliably with most of the refractory elements. Thus, it was apparent that if Zeeman atomic absorption spectrometry was to be accepted as a usable tool for elemental analysis, a new light source which operates more reliably must be developed.

In general, for atomic absorption spectrophotometry, hollow cathode lamps are used for refractory elements and recently, electrodeless discharge lamps are used for volatile elements. The conventional hollow cathode lamps and electrodeless discharge lamps do not operate well in a presence of a high magnetic field, which is used in Zeeman spectroscopy.

SUMMARY OF THE INVENTION

An object of the invention is to devise a discharge lamp which operates in a strong magnetic field for Zeeman atomic absorption spectroscopy. Magnetically contained arc discharge lamps remove all of the difficulties associated with conventional hollow cathode lamps and electrodeless discharge lamps.

In developing the magnetically contained arc discharge lamp, design effort was directed to achieve an ideal lamp condition as closely as possible. An ideal light source for atomic absorption spectrophotometer is the one in which the line profile of the resonance radiation is extremely sharp and of very high intensity with low noise. For Zeeman atomic absorption light source, such lamp must operate in a presence of high magnetic field, typically above 10 KG. Even though there is no ideal light source for atomic absorption spectrometry, the requirement to achieve near ideal lamp can be specified. First of all, in order to achieve a sharp resonance line, the atomic vapor density in the direction in which the resonance radiation propagates must be low so that the self-absorption is minimized. Low density also satisfies the condition which minimizes pressure broadening. The high intensity requirement can be accomplished by high efficiency of excitation of the atomic vapor with high flux electrons which excite the atoms. The excitation cross section is largest at near the threshold energy excitation. Since the threshold energy of excitation for most of the resonance excited states of atoms is a few electron volts, the electrical discharge condition should be such that high electron flux at low electron energy is achieved.

The present magnetically contained arc discharge lamp combines both direct current discharge used in the conventional hollow cathode lamp and radio-frequency excitation in addition to the containment due to crossed electric and magnetic fields. The magnetic containment of the gaseous discharge results in a high current density of both electrons and ions resulting in the production of localized sputtering of the cathode material and localized high density electron impact of the sputtered cathode material resulting in high intensity with small self-reversal.

This invention provides a means of emitting high intensity resonance radiation with Zeeman splittings suitable as a light source for Zeeman atomic absorption spectrophotometry. New features that distinguish this invention from many other inventions in the light sources of the prior art are:

(1) two dimensional containment in the presence of crossed electric and magnetic field resulting in a high intensity radiation of resonance lines; (2) superposition of radio frequency and d.c. voltages in order to control the cathode temperature of the lamp to achieve steady vaporization for stable emission of the spectral lines; (3) emission of predominately resonance radiation due to reduced electron energy of discharge by superposition of d.c. and radio-frequency voltages; (4) extremely high intensity with small self-reversal; (5) most important of all, an ability to emit high intensity resonance radiation in the presence of a high magnetic field, i.e., at least to 30 kilo gauss.

Because of the Zeeman effect, the resonance radiation herein contains several Zeeman split components. Along the direction normal to the magnetic field, the Zeeman components polarized parallel to the magnetic field can be selectively transmitted by means of a linear polarizer oriented in such a way that only linearly polarized light parallel to the magnetic field would be transmitted. A Zeeman component or components polarized parallel to the magnetic field is or are unsuited or shifted much less than those polarized perpendicular to the field, depending on the quantum states involved in the transition. Hence, the light linearly polarized parallel to the magnetic field is absorbed by atomic vapor and light polarized perpendicular to the magnetic field is not. Thus, one polarization ($\pi$) is used to monitor the presence of atoms and interfering non-atomic vapor while the other ($\sigma$polarization) is used to monitor the non-atomic vapor. The difference or ratio of the absorption between the parallel and perpendicular polarization represents the concentration of the atomic vapor regardless of the presence or absence of non-atomic vapor interference. Thus, the present invention can be used for automatic background rejection in the case of atomic absorption (Zeeman atomic absorption spectrophometry) or atomic fluorescence (Zeeman atomic fluorescence spectrometry).

The above and further novel features and objects will appear more fully in detail from the following detailed descriptions of various embodiments.

DESCRIPTION OF THE PREFERRED EMBODIMENT

Figure 1:
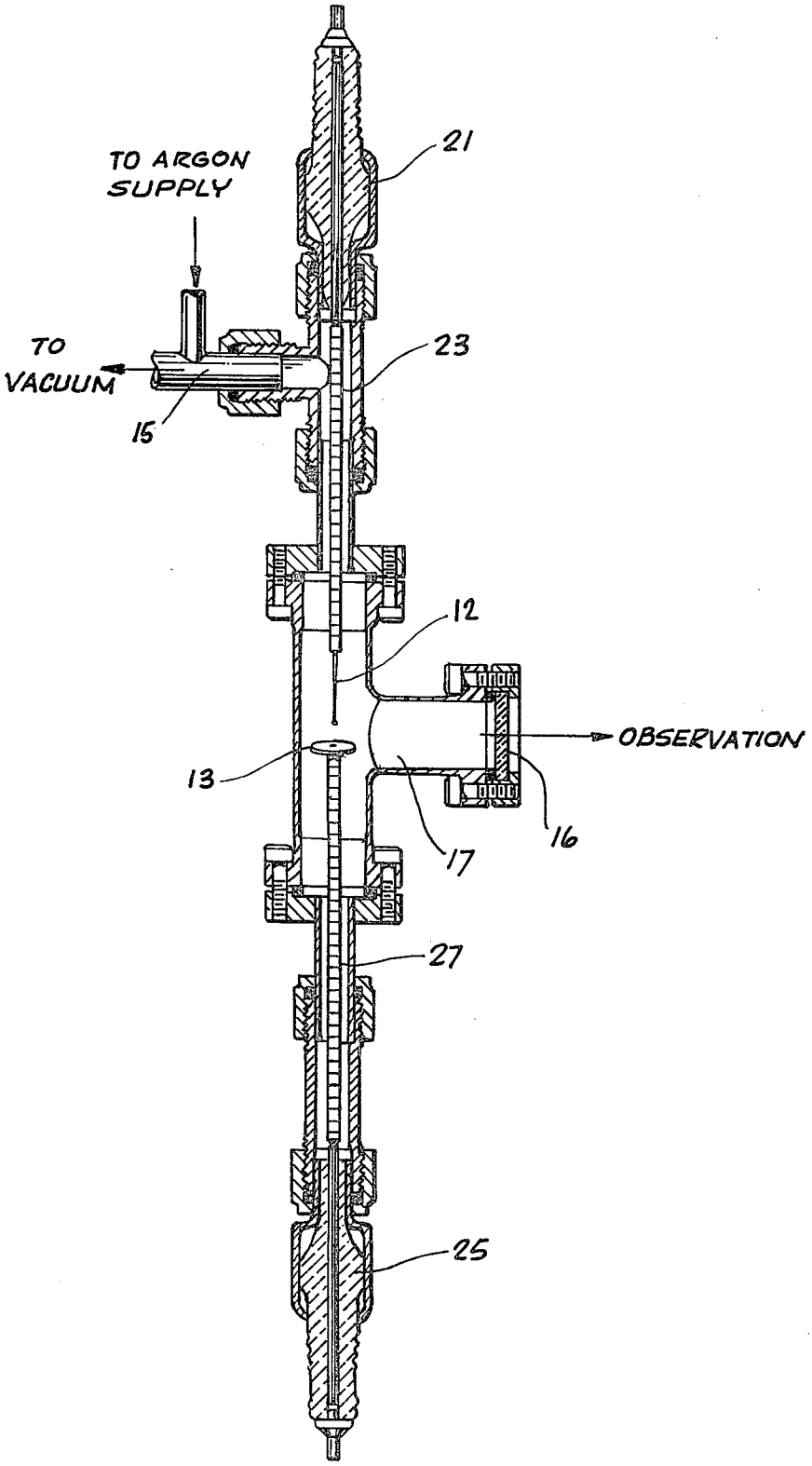
FIG. 1 is a partial cross sectional view of a magnetically contained lamp of the present invention for use in a Zeeman atomic absorption spectrometer.

With reference to FIG. 1, anode 12 consists of a stainless steel wire about 20 mils in diameter which extends into the vacuum chamber 17 by means of a feed-through made out of standard automobile spark plug 21 slightly modified to be connected to the vacuum chamber using a commercially available metal compression seal. Ceramic bead insulators 23 were used to make an electrical insulation of the stainless steel wire from the tip of the spark plug center conducting wire to the tip of the stainless steel wire with about 1 cm exposed area. The cathode 13 is mounted into the vacuum chamber in the same way as the anode by using an identical type feed-through, including a modified spark plug 25 and ceramic bead insulators 27. The cathode consists of a circular disk about ¾ of an inch in diameter and about 20 mils thick made of stainless steel spot welded to the stainless steel wire 20 mil diameter. Ceramic beads 23, 27 were used for both the anode and cathode to prevent electrical discharge to the vacuum chamber, which is made of stainless steel. The vacuum chamber was evacuated by means of vacuum pump through the port 15. Argon gas was fed into the chamber through the same port 15 via a metering valve connected to a vessel containing argon gas. An electrical discharge was caused by applying a positive potential to the anode 12 and a negative potential to the cathode 13 via feed-through 21 and 25 for various values of argon gas pressure ranging from 0.5 torr to about 10 torr. The electrical discharge was observed through the window 16.

This vacuum chamber was placed between the poles of an electromagnet to apply various values of a magnetic field in the direction normal to the axis determined by feed-through 21 and 25, i.e., the magnetic field is applied in the direction normal to the electric field.

Figure 2A:
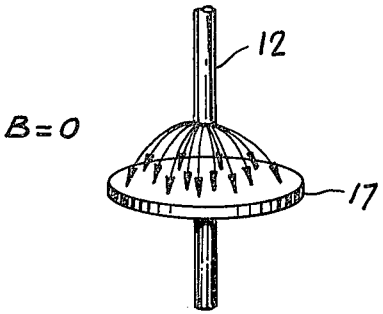
FIG. 2*a* is a schematic representation of ion bombardment of a cathode with a high electric field and zero magnetic field.
Figure 2B:
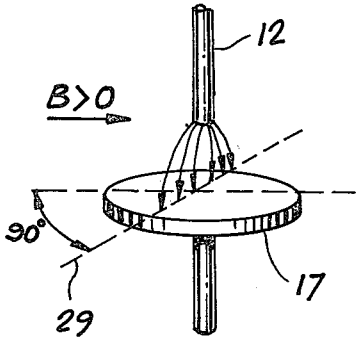
FIG. 2*b* is a schematic representation of ion bombardment of a cathode with a high electric field and a crossed magnetic field.

In FIG. 2*a*, the magnetic field strength is shown at zero where there is a uniform bombardment of the cathode surface by ions. In FIG. 2*b*, a focusing effect occurs at field strengths above 5 K gauss as is indicated by the alignment of field lines, represented by arrows, along line 29. After several minutes of operation at a curent of about 200 mA, an etched channel less than 0.5 mm wide is observable. After several hours of operation, the cathode can be sliced along line 29.

Figure 3:
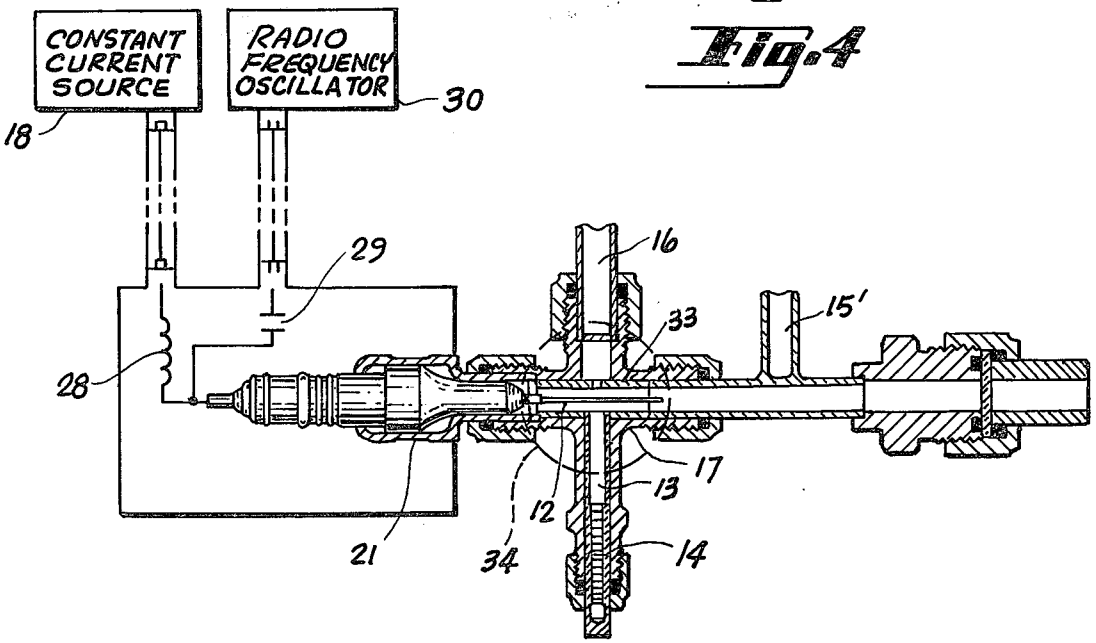
FIG. 3 is a partial cross sectional view of a modified lamp for use in a high strength magnetic field.

FIG. 3 shows a modified magnetically contained arc discharge lamp for use in a Zeeman atomic absorption spectrophotometer. The vacuum chamber 17 was made quite small in the diameter so that it can be placed between the poles of a magnet with a small gap as small as ¼ of an inch so that high magnetic field can be obtained from a small sized magnet. Demountable cathode 13 was inserted into the vacuum chamber through the vacuum seal 14. Anode 12 was inserted into the vacuum chamber through a feed-through 21 made of modified automobile spark plug. The chamber was evacuated by means of a vacuum pump through the port 16 and argon was fed into the chamber through the inlet tube 15'. The vacuum chamber and the demountable cathode were maintained at the ground potential; d.c. and r.f. voltage were fed into the anode 12 from constant current source 18 through r.f. blocking choke 28 and from radio-frequency oscillator 30 through the r.f. coupling capacitor 29 whose value is 1000 pico farads with a 600 volt rating. Radio frequency oscillator 30 was operated at about 40 M Hz with about 15 watts output power. Constant current power supply was capable of delivering maximum current of 300 mA at 600 volts with capability to continuously vary the current from 5 mA to 300 mA. A permanent magnet set at 13 kilo gauss in the air gap was placed in the position indicated by dashed line 34. An aluminum oxide cylindrical insert 33 around the anode wire 12 was inserted into the vacuum chamber 17 so that the electrical discharge can only take place between the anode 12 and the cathode 13. With simultaneous application of radio frequency and d.c. power, stable discharge of the cathode material takes place.

Emitted light emerges from the ultraviolet light transmittig window 16. For refractory elements used in the cathode, radio frequency power is not necessary to obtain the spectral light emission. However, radio frequency power stabilizes the discharge to obtain low noise light emission.

For volatile elements such as As, Se, Cd, Zn, etc., the cathode is loaded with such material as well as other compounds mixed to insure a uniform heating of the volatile material. Because of the superposition of radio frequency power which discharges the argon gas resulting in the reduced breakdown voltage, the power input to the cathode from d.c. power supply can be controlled at will such that almost any desired temperature of the cathode can be maintained. By this temperature control, the temperature of the volatile element material can be set to emit a steady stream of the target material from the cathode. The vaporized volatile elements are excited by radio frequency and d.c. discharge with excellent control resulting in the stable emission of the resonance radiation.

Figure 4:
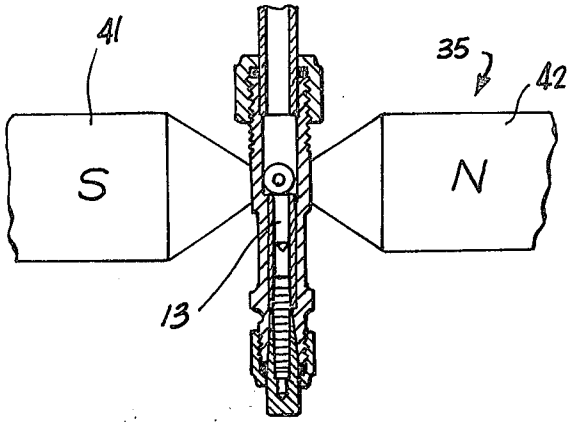
FIG. 4 is a partial cross section of the apparatus of FIG. 3 illustrating how the apparatus is placed between the pole pieces of a small magnet.

FIG. 4 shows the placement of the lamp of FIG. 3 in the air gap of a permanent magnet 35 to obtain high magnetic field strength from a small permanent magnet by keeping the air gap as small as possible. This is accomplished by keeping the width of the lamp where the anode 12 and the end of the cathode 13 are located as small as possible. The lamp is inserted between the pole pieces 41 and 42 resulting in high field strength.

Any elements, either volatile or refractory can be excited by this light source. The most striking feature is that predominantly, only the resonance lines are excited thus simplifying the spectral line characteristics. The reason for this effect is because of simultaneous superposition of both radio frequency and d.c. power results in low energy electrons. Low energy electrons imply that ony those states having lower energy levels can be excited. Almost always, the resonance states are the lowest lying excited states in which the allowed electric dipole transitions occur.

A striking demonstration of the present light source is in the emission spectra from uranium atoms with magnetic field on and off. With no magnetic field, the spectra is extremely complex and very weak in the intensity. With the magnetic field on, the intensity is increased many fold, spectral characteristics show an extreme simplification and there is significant rejection of background spectral components.

Figure 5:
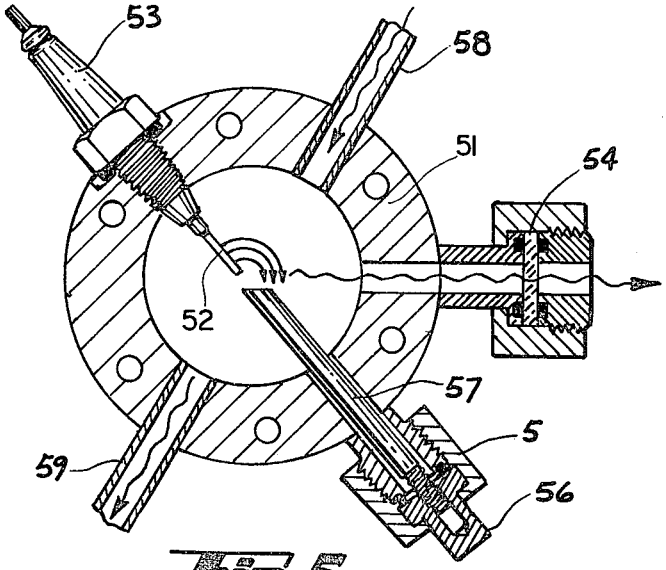
FIG. 5 is a partial cross sectional view of another modified lamp for use in a very high strength magnetic field.

The apparatus of FIG. 5 was modified in such a way to achieve even higher magnetic field strength by placing magnet poles inside the vacuum chamber by using pole pieces as vacuum chamber walls. With this arrangement, a magnetic field as high as 20 KG from a small 8 pound magnet can be realized with a gap width of 3 mm. Thus, a compact light source module can be produced by this technique.

Referring to FIG. 5, commercially available vacuum flange 51, known as Varian conflat, non-rotatable, double sided, 2.75 inch outer diameter, 1 inch thick, with six $\frac{1}{4}$-28 tapped holes, stainless steel, was used as a main vacuum body. An automobile spark plug 53 was used as a feed through for the anode 52. A Cajon VCO O-Ring vacuum coupling with a Supersil quartz window 54 was used as a light emission port and a Cajon VCO coupling with a suitable end plug 56 constructed to hold cathode 57 was used as a demountable cathode holder.

Argon gas was fed into the vacuum chamber through the port 58, and the chamber was evacuated through the pump out port 59.

Figure 6:
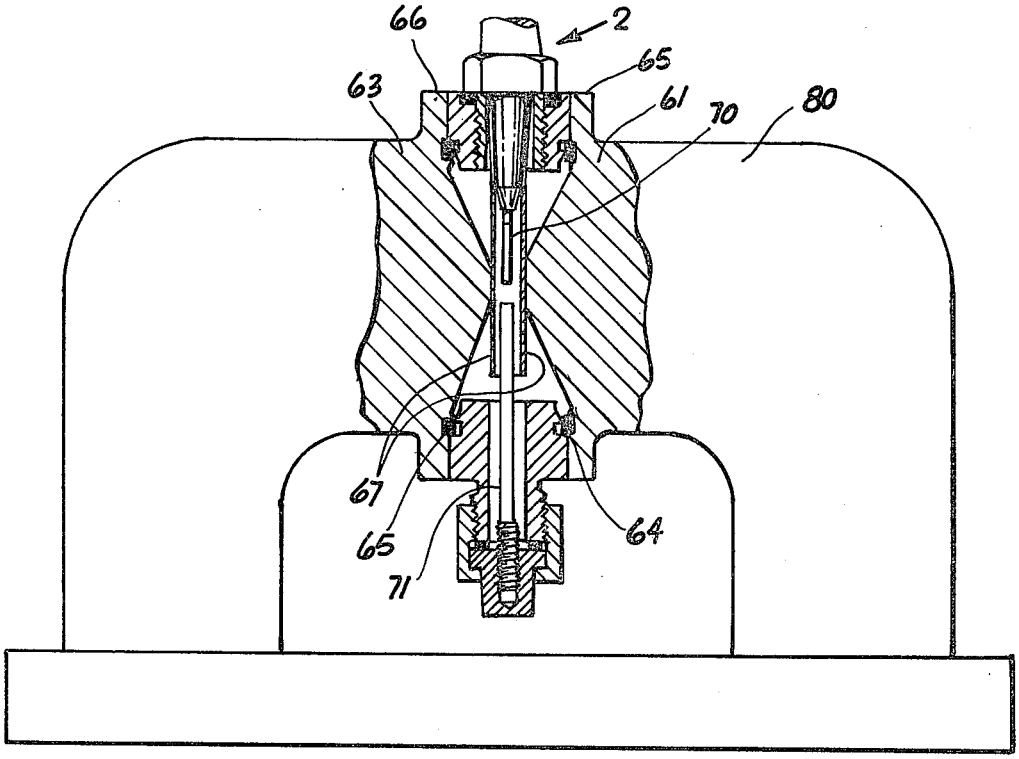
FIG. 6 is a partial cross section of the apparatus of FIG. 5 illustrating how the apparatus is placed between pole pieces of a medium size magnet.

The method used to place pole pieces inside the vacuum chamber is illustrated in FIG. 6. The pole pieces 61 and 63 were welded to flanges 65, 66 and Viton O-rings 64 and 65 (Parker No. 2-223 $\frac{5}{8}$ inch cross section by 1-$\frac{5}{8}$ inch inside diameter) were used as vacuum seals. Mica sheet disks 67 electrically insulated the magnet pole pieces 61 and 63 so that the electrical discharge occurs only between the anode 70 and cathode 71. The permanent magnet 80, weighing only 8 pounds produced 15 KG of magnetic field with 4 mm gap between the pole pieces. The two dimensional containment similar to that described in FIG. 2*b* occurred.

What is claimed is:

1. An arc discharge lamp comprising, an anode and a cathode, said cathode spaced from said anode, means for establishing an electric field between said anode and cathode of a magnitude sufficient to cause an electrical arc discharge therebetween, magnet means having opposed pole pieces with an air gap therebetween for establishing a magnetic field between said anode and cathode, said magnetic field having a field direction perpendicular to said electrical field, housing means for said anode and cathode, said housing means having dimensions fitting within said air gap of said magnet means and having a light emission port for emitting light from said arc discharge, and gas supply means connected to said housing means for delivering an ionizable gas to said housing for ion bombardment of said cathode.

2. The apparatus of claim 1 wherein said cathode is loaded with materials whose spectra is to be observed.

3. The apparatus of claim 1 wherein said housing means is vacuum sealed and having an opening connected to vacuum pumping means.

4. The apparatus of claim 1 wherein said gas supply means is an argon gas supply.

5. The apparatus of claim 1 wherein said means for establishing an electric field comprises a radio frequency power source connected to a constant current source.

6. The apparatus of claim 1 wherein said housing means defines opposed apertures into which opposed pole pieces of said magnet means project and are vacuum sealed thereto.

7. The apparatus of claim 1 wherein said housing means has an anode entry port and a cathode entry port, at least one of said entry ports being sealed with a spark plug modified by using a central conductive path therein as an electrode passageway.

8. The apparatus of claim 1 wherein said magnet means has a field strength between 5 and 20 kilo gauss.

9. The apparatus of claim 1 wherein said housing means is substantially flat proximate to said anode and cathode for close spacing of said pole pieces of said magnet means.

10. The apparatus of claim 2 wherein said cathode materials are selected from refractory and volatile materials.

11. The apparatus of claim 9 wherein the spacing of said pole pieces is less than 10 mm.

12. The apparatus of claim 10 wherein said volatile materials are elemental substances selected from the group consisting of As, Se, Cd, and Zn.

* * * * *